United States Patent [19]

Seegers et al.

[11] 4,250,672

[45] Feb. 17, 1981

[54] EXTERNALLY REINFORCED CONCRETE STAIRS

[75] Inventors: Glen A. Seegers; H. James Seegers, both of Chicago, Ill.

[73] Assignee: American Stair Corporation Inc., Willow Springs, Ill.

[21] Appl. No.: 86,919

[22] Filed: Oct. 22, 1979

Related U.S. Application Data

[63] Continuation-in-part of Ser. No. 967,987, Dec. 4, 1978, abandoned.

[51] Int. Cl.[3] ..... E04F 11/14

[52] U.S. Cl. ..... 52/182; 52/184

[58] Field of Search ..... 52/182, 184, 185, 191

[56] References Cited

U.S. PATENT DOCUMENTS

| | | | |
|---|---|---|---|
| 794,908 | 7/1905 | Winslow | 52/187 |
| 1,291,904 | 1/1919 | Itschner | 52/182 |
| 1,725,541 | 8/1929 | Schick | 52/184 |
| 1,771,405 | 7/1930 | Felsenthal | 52/184 |
| 1,789,574 | 1/1931 | Woodbridge | 52/184 X |
| 2,721,472 | 10/1955 | McAver | 52/191 |

FOREIGN PATENT DOCUMENTS

| | | | |
|---|---|---|---|
| 1082834 | 6/1954 | France | 52/182 |
| 1216474 | 11/1959 | France | 52/182 |

*Primary Examiner*—Alfred C. Perham

*Attorney, Agent, or Firm*—Edward D. Gilhooly

[57] ABSTRACT

An externally reinforced concrete structure including a plurality of elongated C-channels interconnected to form a unitary body. The unitary body created by the C-channels is utilized to function as formwork to aid in erection of a concrete structure and to lend structural support of the concrete upon the concrete being set by creating a stressed-skin construction.

6 Claims, 12 Drawing Figures

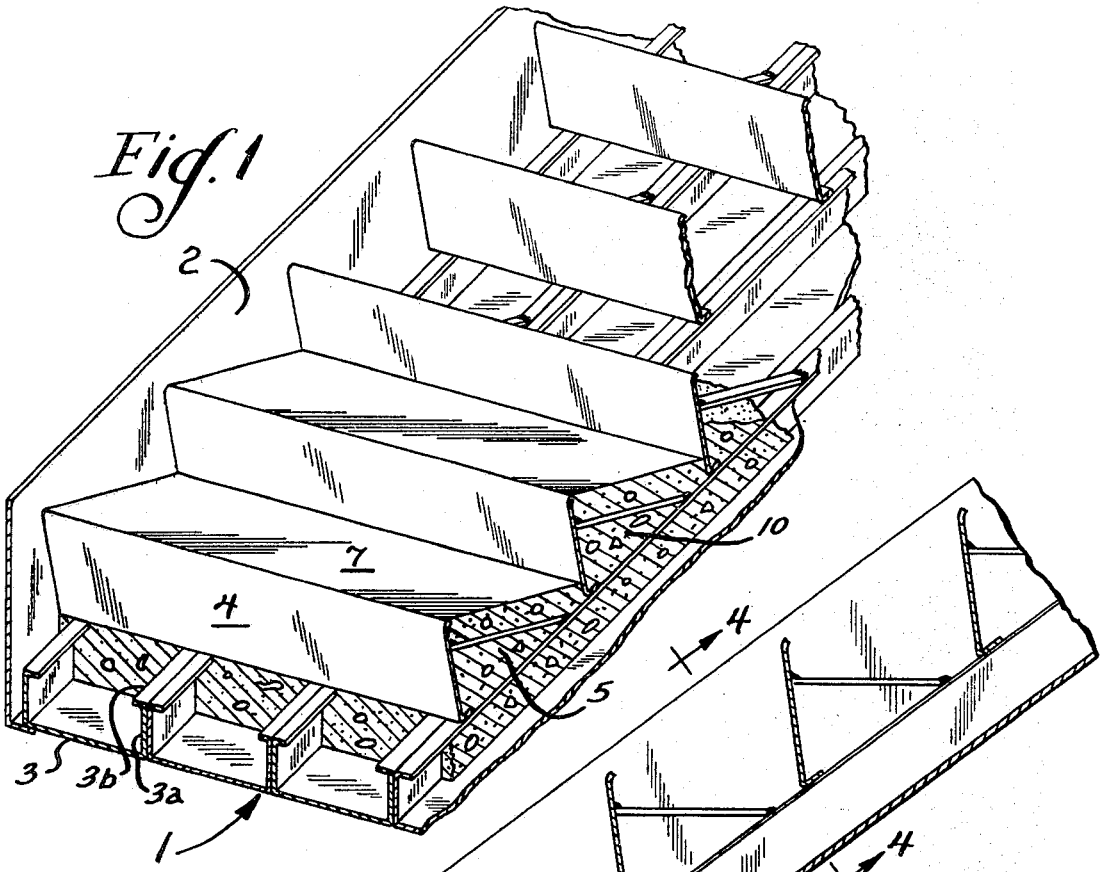
Fig. 1
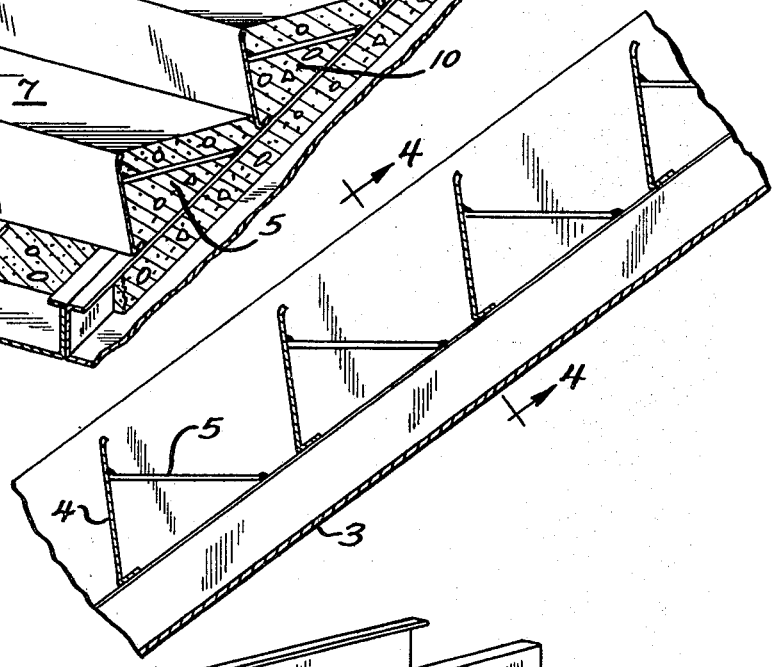
Fig. 2
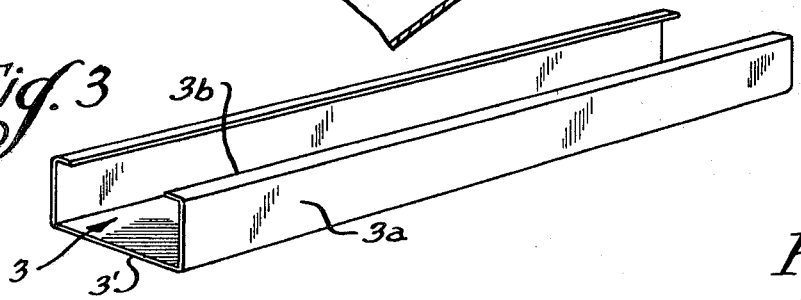
Fig. 3
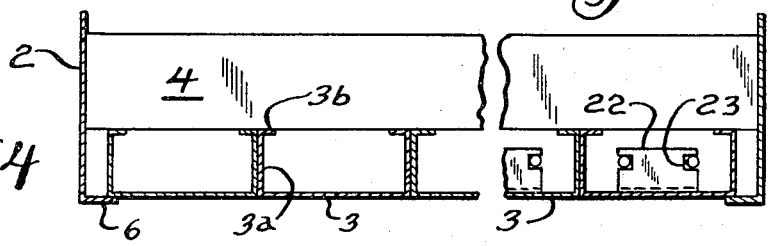
Fig. 4
Fig. 4a

Fig. 5
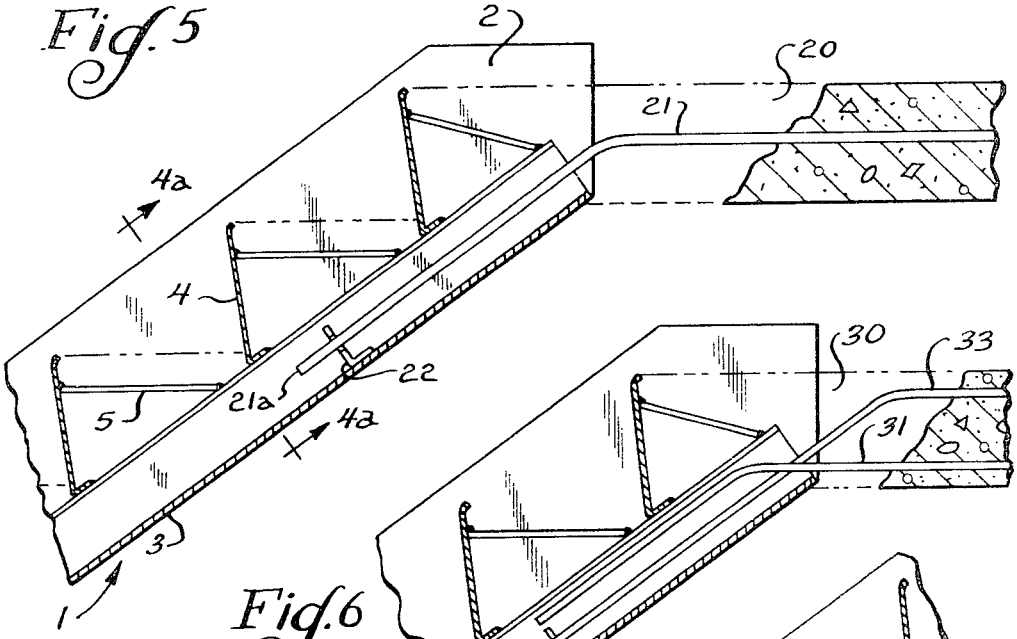
Fig. 6
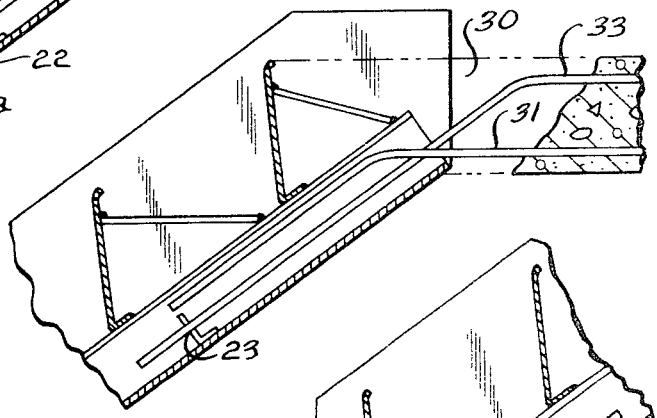
Fig. 7
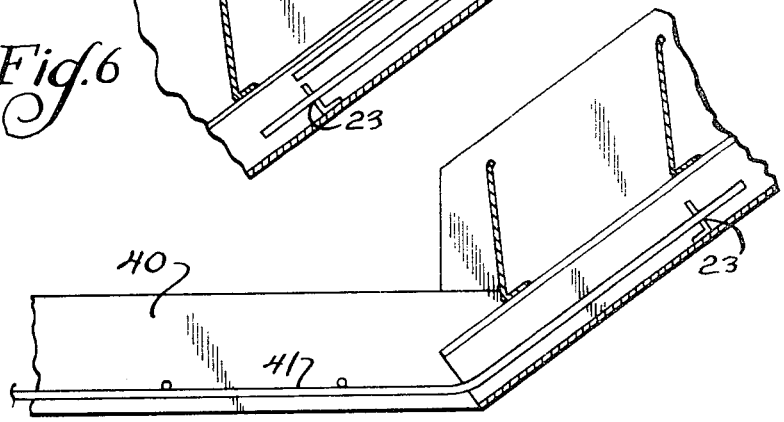
Fig. 9
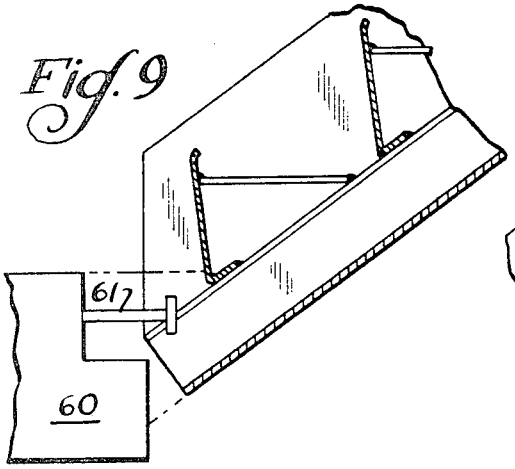
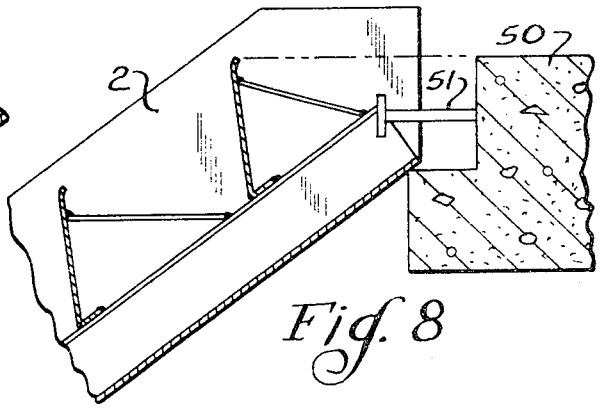
Fig. 8

EXTERNALLY REINFORCED CONCRETE STAIRS

BACKGROUND OF THE INVENTION

This is continuation-in-part of our copending application, Ser. No. 967,987, filed Dec. 4, 1978 entitled "Externally Reinforced Concrete Stairs" and now abandoned.

This invention relates in general to concrete slab structures and, in particular, to a stressed-skin construction.

More specifically, this invention relates to a concrete stairway having a plurality of interconnected soffits which form a stressed-skin structure when erected in a building and the like.

In prior stairway systems used in conjunction with buildings, it has been common practice to construct a formwork comprised of various elements at a building site to receive concrete and form the stair structure in conjunction with the use of risers. The function of the prior art formworks is primarily directed to the retention and control of the concrete when the structure is being erected. With such techniques, the structural elements of the formwork such as soffits or pans do not make any significant contribution to the structural integrity of the stairway after the concrete has set both in a lateral and longitudinal direction.

To attain sufficient load carrying characteristics, a plurality of elongated reinforcement bars extend through the set concrete to add strength internally to the final stair structure. Thus, much of the strength of the concrete structure is significantly attributable to the reinforcing bars, whereby the bottom formwork which receives the concrete plays little or no structural function. The prior art formwork is either removed from the finished structure or is left merely as an aesthetic covering of the bottom surfaces of the concrete stair or landing.

The use of reinforcement bars as strengthening means in a concrete slab construction has resulted in stairs and landings of sufficient and safe strength, but the utilization of such bars also occasions several disadvantages. Structural steel bars in the form of long rods unnecessarily add weight to the structure and contribute significantly to the overall expense of the stairway or landing being installed. Such added expense results both from the cost of materials and the added labor time required of an installer in erecting the stairway. An important factor therefore which creates the need for such reinforcing rods is that the structure of prior art formworks is not intended or capable of adding structural integrity to the set concrete slab.

SUMMARY OF THE INVENTION

It is, therefore, an object of this invention to improve concrete slab structures.

Another object of this invention is to utilize a stressed-skin construction to contribute structural integrity to a slab.

A further object of this invention is to produce a concrete stairway and landing structure eliminating the necessity of reinforcement bars.

Still another object of this invention is to couple a stressed-skin structure of the invention to a conventional concrete structure having reinforcement bars and the like.

These and other objects are attained in accordance with the present invention wherein there is provided an improved concrete slab structure utilizing a stressed-skin construction.

As used in connection with the invention of the application, stressed-skin construction refers to a load carrying structure whose panel, casing or "skin" carries all or a significant part of the internal stresses resisting an applied load. In the case of a stairway, for example, the applied load would include the weight of the structure itself and any load applied thereto. Stiffening members are generally employed in stressed-skin constructions to give the skin support, shape and stability.

The improved structure of the invention utilizes a plurality of elongated troughs integrally coupled together which, upon setting of concrete poured therein, acts as a stressed-skin construction to add structural strength to the concrete slab in the form of an externally reinforced system. The use of the stressed-skin construction of the invention eliminates the necessity of utilizing costly reinforcing bars in the construction of stairways and landings. The construction of a stairway or landing according to the invention achieves such economy from reduced labor and material costs, since the interconnected soffit troughs function both as an initial formwork in which the concrete forming the structure is poured and retained until set and further contributes to the structural strength of the installation upon setting of the concrete. The unique C-shape cross section of the integrally connected troughs achieves a stressed-skin condition in the bottom walls of the troughs while stiffening is contributed by side walls of the troughs. The invention of the application thus provides a technique of forming a landing, stairway or other concrete slab having considerable strength and structural integrity while reducing the expense of erecting these structures attributable to the prior art techniques.

DESCRIPTION OF THE DRAWINGS

Further objects of the invention, together with additional features contributing thereto and advantages accruing therefrom, will be apparent from the followng description of several embodiments of the invention when read in conjunction with the accompanying drawings, wherein:

FIG. 1 is a perspective illustration of a stair system utilizing the improved stressed-skin construction of the invention;

FIG. 2 is a partial sectional illustration of a stairway shown in FIG. 1;

FIG. 3 is a perspective illustration of one of the soffit troughs of the invention utilized in the stairway of FIG. 1;

FIG. 4 is a sectional view taken along line 4—4 illustrating the interconnection of the troughs of the stairway of FIG. 1;

FIG. 4*a* is an end view of the troughs of the invention utilizing an improved damming technique of the invention;

FIG. 5 is a side schematic illustration with parts in section of the coupling of the stressed-skin construction of the invention of a standard prior art structure;

FIG. 6 is another embodiment of the stressed-skin construction of the invention coupled to a standard concrete slab construction;

FIG. 7 is still another embodiment of the stressed-skin construction of the invention coupled to a conventional platform having reinforcement bars;

FIG. 8 is another embodiment of the stressed-skin construction of the invention coupled to a landing at its top;

FIG. 9 is a schematic side illustration of the stressed-skin construction of the invention coupled at its bottom to a landing;

DESCRIPTION OF A PREFERRED EMBODIMENT

Figure 10:
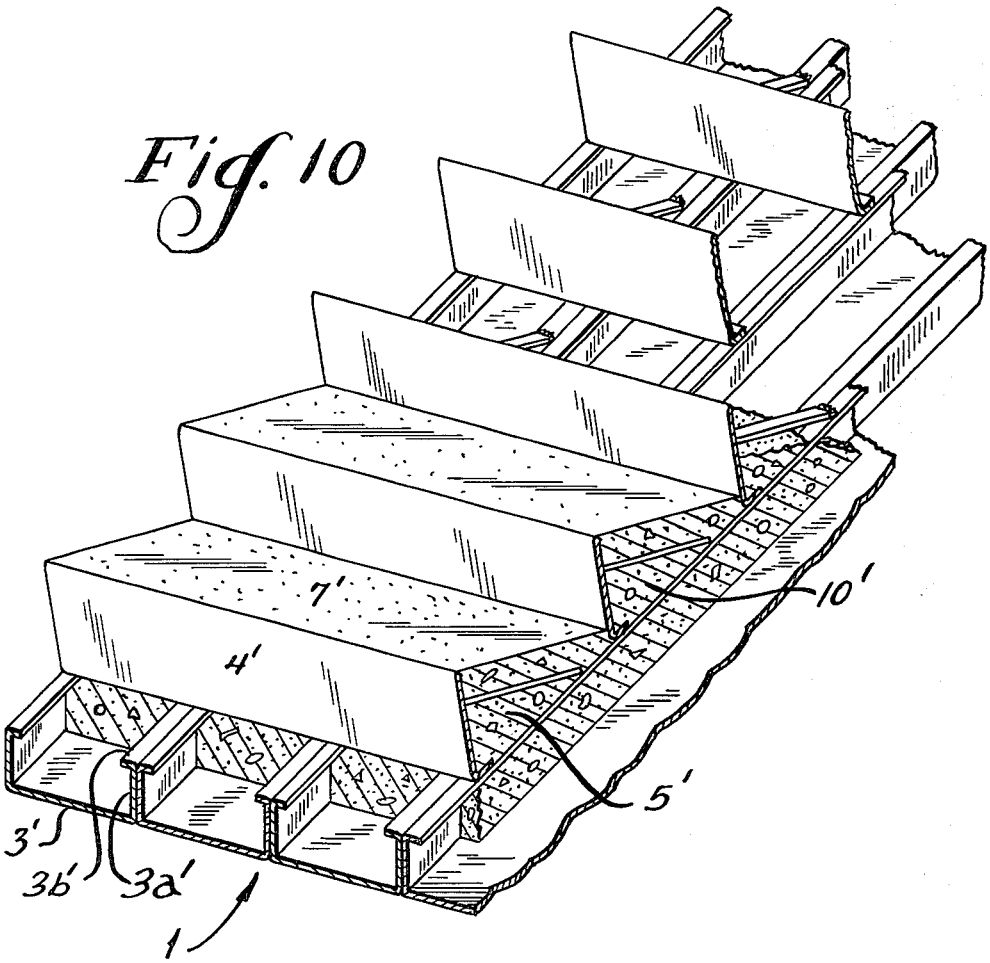
FIG. 10 is a partial side perspective illustration of still another embodiment of the stressed-skin construction of the invention.

Referring now to FIG. 1, there is shown one embodiment of a concrete slab structure having the stressed-skin construction according to the invention. Although the invention is shown and described with reference to use with a concrete slab structure utilized in a stairway system of a building, the technique of the invention of utilizing a stressed-skin construction is not intended to be limited to such an application, since it can be used in conjunction with various types of concrete slab structures for numerous applications.

The externally reinforced structure 1 of the invention shown in FIGS. 1, 2 and 4 is in the form of a stairway having a pair of stringers 2, one of which is illustrated. Structure 1 is a unitized construction having a plurality of pan-like, soffit troughs 3 of a suitable metal affixed together as a single body. The plurality of troughs 3 have elongated bodies to substantially span a desired dimension such as, for example, between a floor and a landing, floor to floor or numerous other well known situations. Elongated troughs 3 are in contact with each other in a side by side arrangement and are welded together or otherwise secured by any suitable method of attachment to create a rigid one piece body.

Troughs 3 are in the form of a C-channel which includes two parallel sidewalls 3*a* having flanges 3*b* extending perpendicular thereto. The outer surface of the sidewalls 3*b* is secured in flush contact with the sidewall of an adjacent trough, whereby the two affixed walls 3*a* rigidize the unitary soffit trough structure created by the plurality of elements. Although the outer surfaces of adjacent walls 3*a* are in flush contact as shown in FIGS. 1 and 4, it should be recognized that the walls 3*a* may be angularly disposed to each other and be affixed at the point of contact, such as created by alternate cross sections of the C-channels.

The tops of the troughs 3*b* are adapted to be coupled to a plurality of riser plates 4 as shown in FIG. 1 supported by means of a suitable number of brackets 5 welded respectively to soffit 3 and riser 4. Soffit troughs 3 and stringer 2 create a continuous bottom wall to receive and control fluent concrete through the use of an inwardly directed flange 6 formed on the bottom of stringers 2, partially projecting under structure 1.

From the foregoing description, it should be apparent that the pair of stringers 2, soffit troughs 3 being integrally interconnected, and risers 4 form a structure which when erected at the job site acts as a formwork to receive a settable material in a fluent state such as unhardened concrete. Upon setting of the concrete as a slab structure, the bottom of soffit 3 formed by the bottom wall 3' becomes a stressed-skin structure carrying internal stresses of the applied load which adds significant structural integrity and strength both laterally and longitudinally to the concrete slab which it supports eliminating the necessity of reinforcing bars required by the prior art. Thus, the integrally coupled soffits perform the dual function of being a formwork and structural component to support the applied load as an external reinforcing agent. If benefit of both the stressed-skin construction of the invention and reinforcing bars is desired, both can be incorporated in the same concrete slab for extra strength in unusually heavy load situations or extreme length.

Referring to FIG. 5, there is illustrated another embodiment of the improved stressed-skin construction of the invention which demonstrates that the novel stressed-skin stairway herein described is capable of being interconnected with a standard landing having conventional reinforcing bars. Specifically, externally reinforced structure 1 and stringer 2 are connectable to standard slab construction such as landing 20 which possesses a plurality of reinforcing bars 21 for its strength. Reinforcing rod 21 extends at its lower end 21*a* into a bracket 22 having a suitable notch to receive the reinforcing bar. Bracket 22 acts as an additional mechanical connection between the bar and the lower portion of the stairway. In such situations, landing 20 may be constructed by conventional techniques using formworks and the like whereby upon setting of the poured concrete a suitable tie between landing 20 and the system of the present invention is achieved with the extension of reinforcing bars into the structure 1 as shown. It has been found that such adequate strength without other elements is created by such attachment of the stressed-skin system having troughs 3 to the conventional reinforcement bars extending from landing 21. This interconnection allows the stressed-skin construction of the invention to be utilized in conjunction with conventional platforms and stairs.

Referring to FIG. 6, there is illustrated still another embodiment of the invention. The embodiment of FIG. 6 is similar to that described with reference to FIG. 5, except that the conventional landing 30 of concrete includes a pair of reinforcing bars which extend downward into the stressed-skin stairway system of the invention. When concrete is poured into the stairway system, a union of suitable strength is created.

Referring to FIG. 7, there is illustrated another technique of utilizing the stressed-skin stairway system of the invention by which the landing is formed at the bottom of the stairway system, and reinforcement bars 41 extend upward into the stressed-skin system of the invention for suitable coupling.

Referring to FIGS. 8 and 9, there are illustrated other uses by which the stressed-skin system of the invention may be coupled above to a landing 50 of concrete by the use of conventional stud 51 or below to a landing 60 by stud 61.

Figure 11:
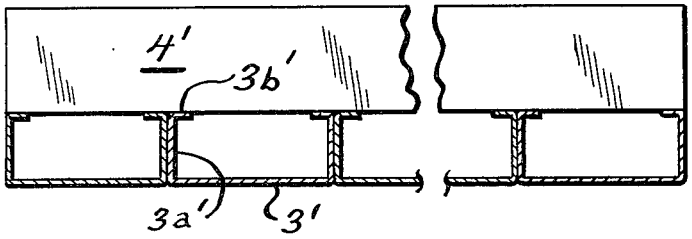
FIG. 11 is a partial end sectional illustration of the embodiment of FIG. 10.

Referring now to FIGS. 10 and 11, there is shown another embodiment of the concrete slab structure having the stressed-skin construction according to the invention. The embodiment of FIGS. 10 and 11 is similar to the embodiment described with reference to FIGS. 1 to 4 with the exception that the stringers are eliminated illustrating the externally-reinforced and self-supporting properties of the stressed-skin construction of the invention.

The externally reinforced structure of the invention shown in FIGS. 10 and 11 is shown used as a stairway and is formed in a unitized construction having a plurality of pan-like, soffit troughs 3' of a suitable metal affixed together as a single body self-supporting unit. The plurality of troughs 3' have elongated bodies to substantially span a desired dimension such as, for example, between a floor and a landing, floor to floor or numerous other well known situations. Elongated troughs 3' are in contact with each other in a side by side arrangement and are welded together or otherwise secured by any suitable method of attachment to create a rigid one piece body.

Troughs 3' are in the form of a C-channel which includes two parallel sidewalls 3a' having flanges 3b extending perpendicular thereto. The outer surface of the sidewalls 3b' is secured in flush contact with the sidewall of an adjacent trough, whereby the two affixed walls 3a' rigidize the unitary soffit trough structure created by the plurality of elements. Although the outer surfaces of adjacent walls 3a are in flush contact as shown in FIGS. 1 to 4, it should be recognized that the walls 3a' may be angularly disposed to each other and be affixed at the point of contact, such as created by alternate cross sections of the C-channels.

The tops of the troughs 3b' are adapted to be coupled to a plurality of riser plates 4' as shown in FIG. 10 supported by means of a suitable number of brackets 5' welded respectively to soffit 3' and riser 4'. Soffit troughs 3' create a continuous bottom wall to receive and control fluent concrete.

From the foregoing description, it should be apparent that soffit troughs 3, being integrally interconnected, and risers 4 form a structure which when erected at the job site acts as a formwork to receive a settable material in a fluent state such as unhardened concrete. Upon setting of the concrete as a slab structure, the bottom of soffit 3 formed by bottom wall 3' becomes a stressed-skin structure carrying internal stresses of the applied load which adds significant structural integrity and strength both laterally and longitudinally to the concrete slab which it supports eliminating the necessity of reinforcing bars, stringers and other external support members required by the prior art. Thus, the integrally coupled soffits perform the dual function of being a formwork and structural component to support the applied load as an external reinforcing agent. If benefit of both the stressed-skin construction of the invention and reinforcing bars is desired, both can be incorporated in the same concrete slab for extra strength in unusually heavy load situations or extreme length. In the embodiment of FIGS. 1 to 4, the stringers are used for purely aesthic or conventional reasons, but are not needed to support the concrete slab construction because of the self-supporting stressed skin structure of the invention. As shown in FIGS. 10 and 11, the stressed-sking construction of the invention does not requre stringers since the load is carried by troughs 3' integrally coupled as a unit to support the load.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. An externally reinforced stairway structure comprising a plurality of elongated soffit members arranged in a side by side relationship and adapted to be supported solely at their respective ends, means for supporting said soffit members solely at said ends, each of said soffit members having a bottom wall and a pair of spaced sidewalls integrally projecting from said bottom wall, said bottom wall and sidewalls extending longitudinally between said ends of said soffit members, at least one of said spaced sidewalls of said soffit members being rigidly coupled to the sidewall of an adjacent soffit member to form a unitary support structure, said soffit member acting as a formwork created by said bottom wall and said pair of spaced sidewalls to receive settable material in a fluent state, riser means coupled to said soffit members adapted to form a plurality of steps from said settable material, a settable material arranged in a fluent state on said formwork created by said soffit members and said riser means and being supported by said soffit members and said riser means upon setting, and said soffit members further acting as a stressed skin structure to provide lateral and longitudinal strength to said material upon setting, said stressed skin structure being created by said bottom wall of each soffit member acting as a stressed skin member, said bottom wall of each soffit member carrying a significant part of the load applied to the soffit members upon setting of said fluent material.

2. The structure of claim 1 wherein said pair of sidewalls of each of said soffit members lie in a plane disposed substantially perpendicular to said bottom wall.

3. The structure of claim 2 wherein said contacting sidewalls are coupled together to form said unitary structure.

4. The structure of claim 1 wherein a plurality of soffit members comprises three or more members.

5. The structure of claim 1 wherein said spaced sidewalls include an edge having an angular disposed portion to support a riser coupled thereto.

6. The structure of claim 1 wherein at least one reinforcing bar extends into a portion of said settable material in spaced relation to said plurality of soffit members, said reinforcing bar acting to couple said unitary structure to a concrete structure at least one reinforcing bar.

* * * * *